US008514670B2

(12) United States Patent
Goeller

(10) Patent No.: US 8,514,670 B2
(45) Date of Patent: Aug. 20, 2013

(54) STRIKING MECHANISM FOR A WATCH WITH A HAMMER LOCKING DEVICE

(75) Inventor: Eric Goeller, Les Hopitaux-Vieux (FR)

(73) Assignee: Montres Breguet SA, l'Abbaye (CH)

( * ) Notice: Subject to any disclaimer, the term of this patent is extended or adjusted under 35 U.S.C. 154(b) by 23 days.

(21) Appl. No.: 13/357,967

(22) Filed: Jan. 25, 2012

(65) Prior Publication Data

US 2012/0195174 A1 Aug. 2, 2012

(30) Foreign Application Priority Data

Jan. 28, 2011 (CH) ..... 0142/11

(51) Int. Cl.
*G04B 25/00* (2006.01)

(52) U.S. Cl.
USPC ..... 368/273; 368/243

(58) Field of Classification Search
USPC ..... 368/243, 269–271, 273, 244
See application file for complete search history.

(56) References Cited

U.S. PATENT DOCUMENTS

| | | | | |
|---|---|---|---|---|
| 2,948,105 | A * | 8/1960 | Levy | 368/244 |
| 3,315,460 | A * | 4/1967 | Odenbach | 368/245 |
| 3,777,701 | A * | 12/1973 | Nofziger | 116/149 |
| 7,021,819 | B2 * | 4/2006 | Schmiedchen | 368/147 |
| 7,292,505 | B2 | 11/2007 | Schmiedchen | |
| 7,742,362 | B2 * | 6/2010 | Corthesy et al. | 368/72 |
| 2006/0133217 | A1 | 6/2006 | Schmiedchen | |
| 2011/0158058 | A1 * | 6/2011 | Marechal et al. | 368/243 |
| 2011/0211426 | A1 * | 9/2011 | Favre et al. | 368/243 |

FOREIGN PATENT DOCUMENTS

| | | | |
|---|---|---|---|
| EP | 1 394 637 | A1 | 3/2004 |
| EP | 1 574 917 | A2 | 9/2005 |
| EP | 1 672 442 | A1 | 6/2006 |
| EP | 2 048 548 | A2 | 4/2009 |

OTHER PUBLICATIONS

U.S. Appl. No. 13/413,299, filed Mar. 6, 2012, Goeller.
U.S. Appl. No. 13/413,214, filed Mar. 6, 2012, Goeller.
U.S. Appl. No. 13/413,048, filed Mar. 6, 2012, Goeller, et al.
Swiss Search Report issued Jun. 9, 2011, in Swiss Application No. CH00142/11, filed Jan. 28, 2011 (with English Translation of Category of Cited Documents).

* cited by examiner

*Primary Examiner* — Sean Kayes
(74) *Attorney, Agent, or Firm* — Oblon, Spivak, McClelland, Maier & Neustadt, L.L.P.

(57) ABSTRACT

The striking mechanism for a watch includes a gong, which is connected to a gong-carrier, a hammer for striking the gong at pre-determined times, a damper counterspring for keeping the hammer at a distance from the gong in an idle mode, and a hammer drive spring, which includes a fixed end and an end that is free to move. The striking mechanism includes a locking device, which is provided with at least one rotating bolt. This bolt includes a first arm provided with a hook for hooking onto a notch of the hammer to lock the hammer in an idle mode. The locking device is arranged to lock the hammer following a single strike of the hammer against the gong in a strike mode.

15 Claims, 3 Drawing Sheets

STRIKING MECHANISM FOR A WATCH WITH A HAMMER LOCKING DEVICE

This application claims priority from Swiss Patent Application No. 00142/11 filed Jan. 28, 2011, the entire disclosure of which is incorporated herein by reference.

FIELD OF THE INVENTION

The invention concerns a striking mechanism for a watch provided with a hammer locking device. The mechanism includes at least one hammer, which is arranged to strike at least one gong secured to a gong-carrier, at determined times. Said hammer is held at a distance from the gong by a damper counterspring in an idle mode and is locked by the locking device. A drive spring for the mechanism hammer can be configured in the form of a resilient strip or beam. This drive spring can be wound to drive said hammer against the gong in the strike mode to provide an acoustic signal, for example, of a programmed time period.

BACKGROUND OF THE INVENTION

Within the field of watchmaking, a striking mechanism can be combined with a conventional watch movement to act as a minute repeater or to indicate a programmed alarm time. This type of striking mechanism generally includes at least one gong made of sapphire or quartz or metallic material, such as steel, bronze, precious metal or metallic glass. The gong may describe, for example, at least one portion of a circle around the watch movement inside the watch frame. The gong is fixed by at least one end thereof to a gong-carrier, which is in turn secured to a watch plate. A strike-hammer is rotatably mounted on the plate, for example, in proximity to the gong-carrier, so as to strike the gong and cause it to vibrate. The sound produced when the gong is struck by the hammer is within the audible frequency range of 1 kHz to 20 kHz. This indicates to the person wearing the watch a well defined time, a programmed alarm or a minute repeater.

As shown in EP Patent Application No. 1 574 917 A1, the striking mechanism of a watch may include two or more gongs, each fixed via one end thereof to the same gong-carrier, which is in turn secured to a plate. Each gong may be struck by a respective hammer. To achieve this, each hammer is driven by its own drive spring, which must have been pre-wound, so as to drive the hammer against the gong, to indicate a minute repeater or an alarm time. Two damper countersprings are each provided to push back and hold the two hammers away from the gongs in an idle mode. In the strike mode, the damper countersprings act with significant force to slow down the fall of each hammer prior to the strike against the respective gong. After the strike, these countersprings allow each hammer to be pushed back to its idle position. Eccentrics are also provided for adjusting the operation of the countersprings essentially to prevent each hammer from rebounding against the respective gong.

One drawback of this type of striking mechanism structure with countersprings is that there is a significant loss of kinetic energy when the hammer strikes the respective gong, which reduces the acoustic level of the striking work. This energy loss is largely due to the slowing down imposed by each counterspring on the path of the hammer when it strikes the gong. Moreover, even if the pre-winding of the drive springs is increased, this involves adapting the countersprings via their eccentric, also to prevent any rebound, which is another drawback of this type of striking mechanism.

EP Patent Application No. 1 394 637 A1 also discloses a striking mechanism fitted with at least one gong and a hammer capable of striking the gong at determined times. This striking mechanism further includes a control device which, on the one hand, provides a visual indication of the active or inactive state of the mechanism, and, on the other hand, can lock or unlock the hammer via a push-button. When the hammer is in an unlocked state in the strike mode, there is nothing to prevent the hammer rebounding against the gong following the first strike of the hammer against the gong, which is a drawback.

SUMMARY OF THE INVENTION

It is thus an object of the invention to overcome the drawbacks of the aforementioned state of the art by providing a watch striking mechanism, which includes a hammer locking device to prevent the hammer from rebounding against the gong following a first strike in the strike mode, without any significant loss of energy when the hammer falls against the gong.

The invention therefore concerns a watch striking mechanism, including:

- a gong, which is connected to a gong-carrier,
- a hammer for striking the gong at predetermined times,
- a damper counterspring for keeping the hammer at a distance from the gong in an idle mode, and
- a drive spring for the hammer, which includes a fixed end and an end that is free to move, said drive spring being able to be wound to drive said hammer against the gong in a strike mode in order to produce an acoustic sound, wherein the striking mechanism includes a locking device provided with at least one bolt, which is intended to lock the hammer in an idle mode, and to be moved away from the hammer in a strike mode, when the drive spring is wound, the locking device being arranged such that the drive spring drives the hammer to strike the gong for a first time before the bolt locks the hammer in the idle position following the first strike.

Specific embodiments of the watch striking mechanism are defined in the dependent claims 2 to 15.

One advantage of the striking mechanism according to this invention lies in the fact that it includes a locking device fitted with at least one slide or bolt, which locks the hammer in an idle mode or following the first strike of the hammer against the gong in the strike mode. The bolt may include a hook, particularly for hooking onto a notch made at the periphery of the rotating hammer. When the drive spring is wound in the strike mode, the hook of the bolt is moved away from the periphery of the hammer so that it can no longer lock said hammer directly. After the spring has been wound, the hammer is driven in the direction of the gong to strike said gong a first time before the bolt, with a time lag, is applied to the periphery of the hammer in order to lock it. This means that there is no rebound of the hammer against the gong, and the counterspring no longer needs to apply a large force to the hammer to return it to the idle position and hold it at a distance from the gong in the idle mode.

BRIEF DESCRIPTION OF THE DRAWINGS

The objects, advantages and features of the watch striking mechanism will appear more clearly in the following description, particularly with reference to the drawings, in which.

DETAILED DESCRIPTION OF THE INVENTION

In the following description, all the parts of the watch striking mechanism that are well known in this technical field will be only briefly described. The emphasis is mainly on how the hammer locking device operates in the idle mode and in the strike mode to prevent any rebound of the hammer against the gong following a first strike.

Figure 1:
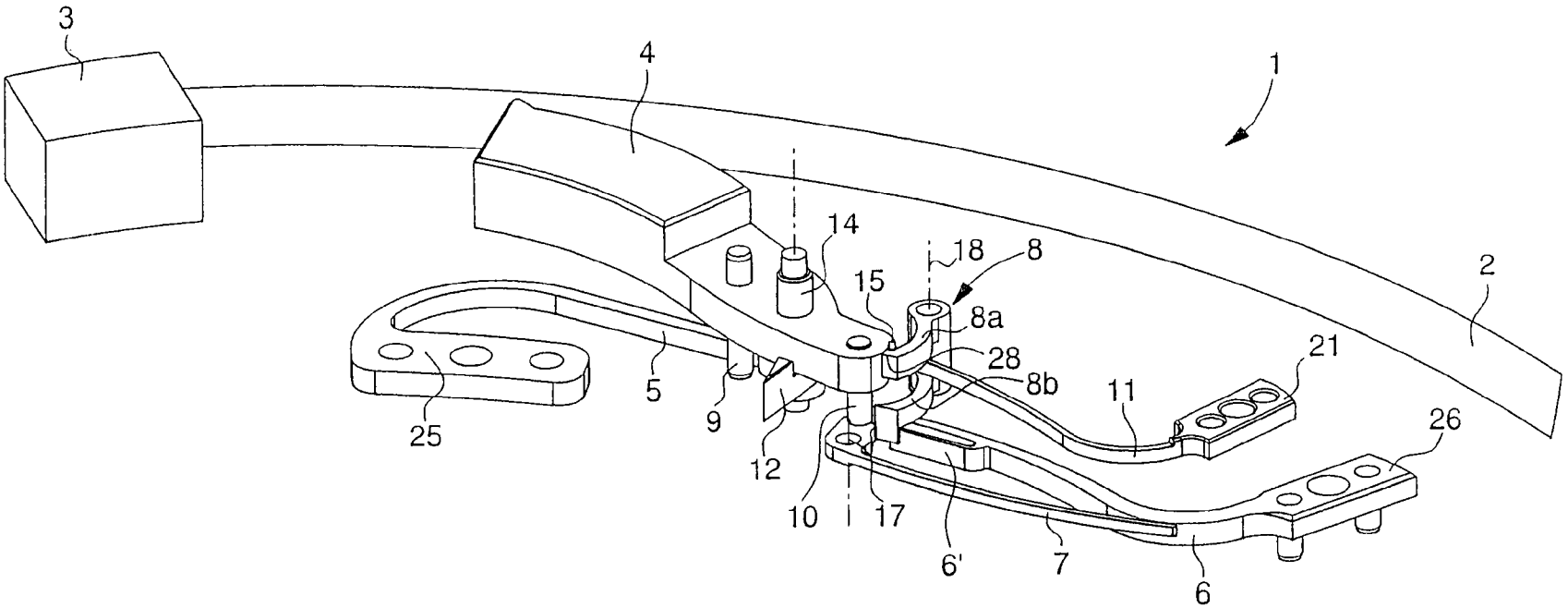
FIG. 1 shows a simplified three-dimensional view of certain parts of the striking mechanism fitted with the hammer locking device according to the invention.

FIG. 1 shows a simplified view of a striking mechanism 1 for a watch. The various parts of striking mechanism 1 are normally mounted on a plate or a bridge which are not shown to avoid overloading FIG. 1. The plate is normally located above the various illustrated elements of the striking mechanism, whereas one part of the bridge is located underneath the illustrated elements, and is also secured to the plate.

The striking mechanism 1 includes at least one gong 2, which is secured at one end thereof to a gong-carrier 3. This gong-carrier may, in theory, be secured to the watch plate (not shown), but may also be secured to an internal part of the case. The other end of the gong 2 (not shown) is generally free to move. Gong 2 can be made in the form of at least one portion of a circle or rectangle about the watch movement. The gong may also be, for example, a metal wire of circular or rectangular transverse section, which is generally made of steel or precious metal or metallic glass or another material.

Striking mechanism 1 also includes at least one hammer 4, rotatably mounted about an axis 14 between a plate and a bridge which are not shown. This hammer is preferably mounted in proximity to gong-carrier 3. Striking mechanism 1 further includes a damper counterspring 5 and a drive spring 6 for the hammer. Damper counterspring 5 holds hammer 4 at a distance from gong 2 in an idle mode and pushes it back to the idle position in a strike mode. Damper counterspring 5 and drive spring 6 take the form of an elastic strip. One end 25 of counterspring 5 and one end 26 of drive spring 6 are fixed to the bridge or the plate (not shown). A free end of counterspring 5 holds hammer 4 at a distance from gong 2 via a shaft 9, fixed through one part of the hammer between the axis of rotation 14 and the impact portion of the hammer.

Drive spring 6 can be wound to drive the hammer in the direction of gong 2 in a strike mode in order to produce an acoustic sound. Drive spring 6 is pre-wound via a lever 12, which is rotatably mounted on axis of rotation 14 of hammer 4. This lever 12 has a tooth, visible in FIG. 1, which is normally actuated by a toothed wheel (not shown) rotatably mounted on the plate or bridge. When lever 12 is driven in rotation by one tooth of the toothed wheel, lever 12 drives shaft 9 of hammer 4 to rotate it about its axis of rotation 14, in the anticlockwise direction in FIG. 1.

Hammer 4 also includes a pin 10, which is fixed in an aperture of the hammer in an end portion, opposite the impact portion relative to the axis of rotation 14. This pin 10 is preferably arranged parallel to axis of rotation 14 and mainly only extends on a bottom side of the hammer. When hammer 4 rotates anticlockwise via the action of lever 12, pin 10 pushes the free end of drive spring 6 towards its pre-wound position at the start of a strike mode. A lever spring 11, which takes the form of an elastic strip and is fixed at one end 21 to the bridge or to the plate, is also provided for pushing, via the free end thereof, the lever 12 to hold it in contact with shaft 9.

According to the invention, the striking mechanism further includes a hammer locking device. This locking device, which will be explained in detail below, particularly with reference to FIGS. 2*a* to 2*c*, essentially includes a bolt 8. This bolt 8 is rotatably mounted along an axis of rotation 18 between the bridge and the plate, which may be parallel to axis of rotation 14 of hammer 4. Bolt 8 includes a first arm 8*a* which may be bowed in shape. The free end of first arm 8*a* is provided with a hooking element in the form of a hook 28. This hook is intended to hook onto or abut against a hooking means, which is a notch 15, made on a lateral surface at the periphery of the end portion of hammer 4, opposite the impact portion. When hook 28 is in contact with the periphery of the hammer, it abuts against or hooks onto notch 15 of the hammer in order to lock it. This prevents the impact portion of the hammer from rotating clockwise in the direction of the gong in the strike mode following the first strike. Notch 15 may be a flat portion arranged at a right angle or an acute angle from the lateral surface of the hammer to lock the hammer by means of hook 28 of first arm 8*a*.

Bolt 8 further includes a second arm 8*b*, which may be arranged parallel to the first arm 8*a* and also be of the same bowed shape. The free end of this second arm 8*b* includes a ramp-shaped portion, against which a complementary strip spring 6' of drive spring 6 abuts. This strip spring 6' is integral with the main strip of drive spring 6, which is made in spring steel. Preferably, this complementary strip spring 6' of the locking device is parallel to the main strip of drive spring 6, with the free end of the complementary strip spring slightly set back from the free end of the main strip of the drive spring. When strip spring 6' is abutting against the ramp of the second arm, this pushes bolt 8 so that first arm 8*a* abuts against the periphery of the hammer to lock it. However, when drive spring 6 is pre-wound, strip spring 6' is no longer abutting against the ramp of second arm 8*b*.

The locking device further includes a bolt spring 7 in the form of a lever, which is rotatably mounted about an axis of rotation 17 on the bridge and, for example, parallel to axis of rotation 14 of hammer 4. Bolt spring 7 includes an elastic strip, a first free end of which comes to rest on a part of drive spring 6 in order to be able to generate a return force in the clockwise direction. Bolt spring 7 further includes a portion of a second end in proximity to axis of rotation 17. The function of this edge of the end portion of bolt spring 7 is to push the second arm 8*b* away from the periphery of the hammer, when the complementary strip spring 6' is no longer in contact with the ramp of second arm 8*b*. This end portion pushes second arm 8*b* via the force generated by the strip bending as it abuts against drive spring 6. This also moves hook 28 of first arm 8*a* away from the periphery of hammer 4 so that said hook no longer locks said hammer.

The end portion of bolt spring 7 further includes a groove in the shape of an arc of a circle for receiving the pin 10 of hammer 4, when the hammer strikes the gong the first time. Prior to the strike of the hammer against gong 2, the end portion of bolt spring 7 holds second arm 8*b*, and first arm 8*a* at a distance from the periphery of hammer 4. In the strike mode, when drive spring 6 drives hammer 4 in the direction of gong 2, hook 28 of first arm 8*a* cannot hook onto notch 15 of the hammer yet, since the end portion of bolt spring 7 is still holding second arm 8*a* at a distance. Complementary strip spring 6' comes into contact with the ramp of the second arm when the hammer is being driven, but does not have sufficient force to push second arm 8*b* directly in the direction of the periphery of the hammer to lock said hammer. This force is also dependent upon the inclination of the ramp, which can be adjusted.

Once the hammer strikes gong 2 for the first time, hammer pin 10 enters the circular groove of the end portion of bolt spring 7. With the movement of pin 10 in said groove, the end portion of bolt spring 7 is forced to turn slightly in an anti-clockwise direction in FIG. 1. The first end of the elastic strip of bolt spring 7, which is in contact with drive spring 6, then bends. This has the effect of allowing complementary strip spring 6' in contact with the ramp of second arm 8*b* to push second arm 8*b*, and first arm 8*a* in the direction of the periphery of hammer 4. Hook 28 of first arm 8*a* thus abuts against notch 15 of the hammer following the first strike of the gong, when the hammer is pushed back by counterspring 5 into the idle position. Once hammer 4 returns to the idle position, the end portion no longer has sufficient force to push second arm 8*b* away from the hammer, given the contact between the end of complementary strip spring 6' and the ramp. The hammer is thus directly locked after a single strike of the gong without any subsequent rebound, which is an object of the invention.

Due to the hammer locking device, counterspring 5 no longer requires a large reaction force to return the hammer to the idle position after the gong has been struck. By way of comparison, counterspring 5 requires only a force on the order of 0.1 N to return the hammer to the idle position in accordance with the invention with the aforementioned locking device. For a conventional striking mechanism, the counterspring must theoretically push the hammer back with a force on the order of 3 N to prevent any rebound. The pre-wound drive spring normally generates a force on the order of 1 N for pushing the hammer towards the gong.

Figure 2A:
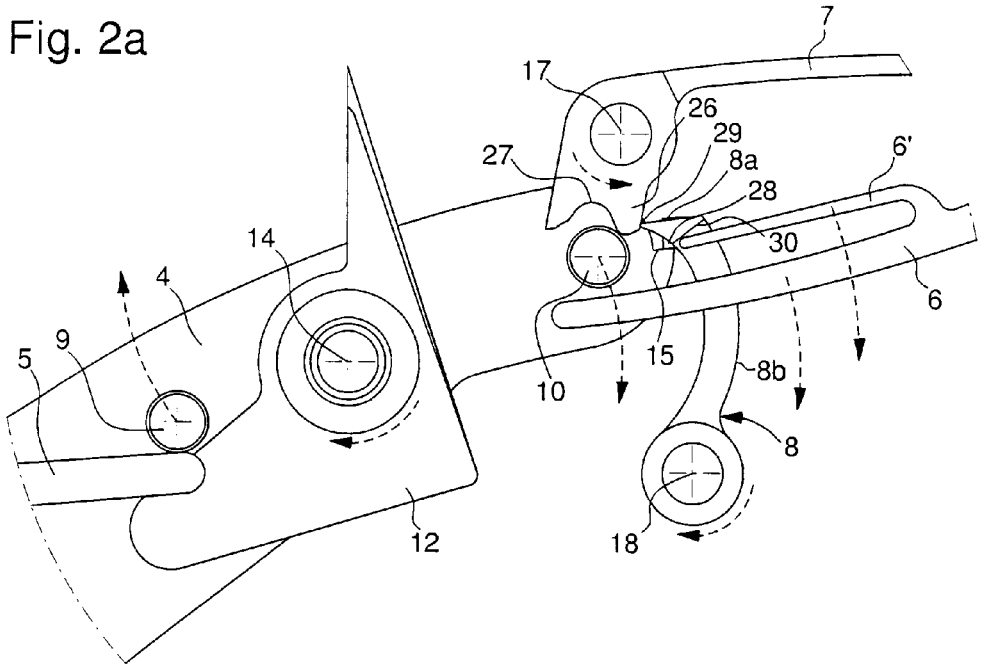
FIGS. 2*a* to 2*c* show enlarged plan views of various positions, from an idle mode to a strike mode, of the main elements of the striking mechanism fitted with the hammer locking device according to the invention.
Figure 2B:
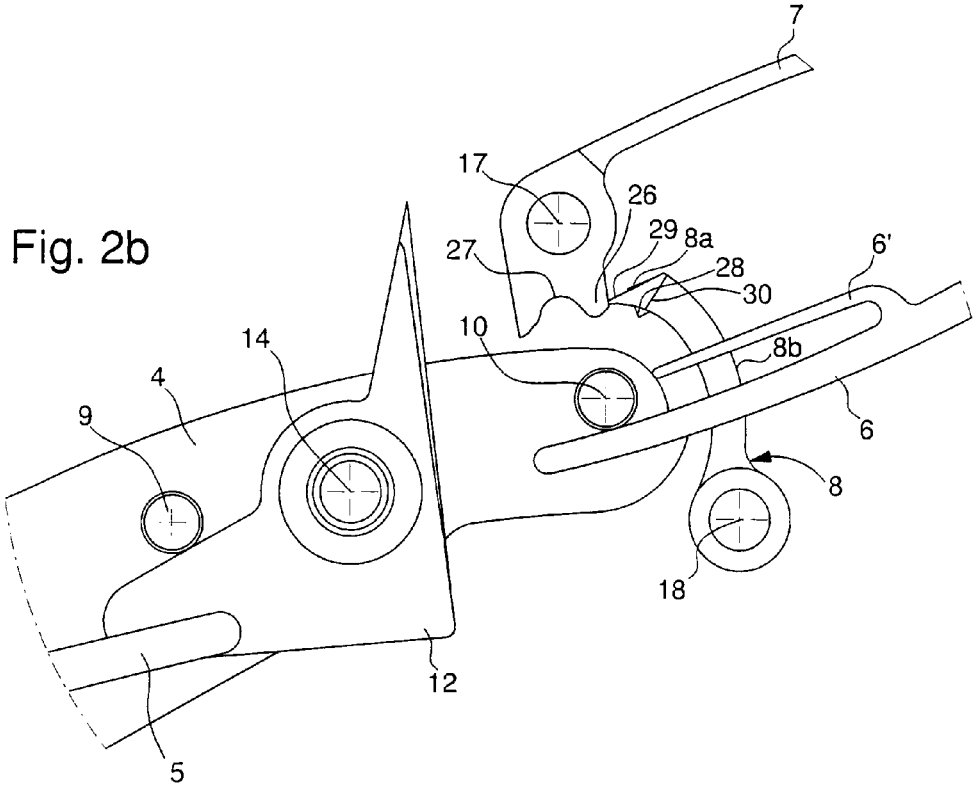
Figure 2C:
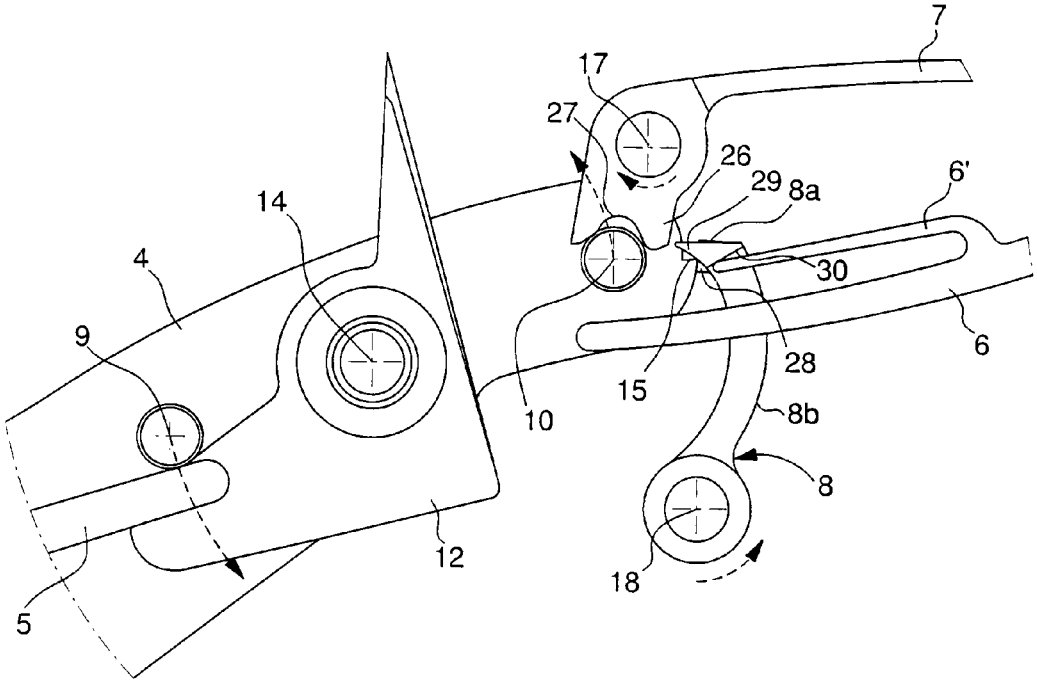

Reference is made to FIGS. 2*a* to 2*c* for better comprehension of the locking device of the striking mechanism according to the invention. These FIGS. 2*a* to 2*c* show enlarged views of the locking device of the mechanism, the elements of which are shown from below relative to FIG. 1. FIG. 2*a* shows the striking mechanism in an idle position with bolt 8 of the locking device, which locks the hammer 4. FIG. 2*b* shows an initial position of the strike mode with the pre-wound drive spring. Finally, FIG. 2*c* shows the moment when hammer 4 first strikes the gong, with the first and second arms 8*a* and 8*b* driven to come back into contact with the periphery of the hammer, but prior to the hammer being locked.

In FIG. 2*a*, the striking mechanism is in an idle mode. Bolt 8 of the locking device keeps hammer 4 locked. To achieve this, the bolt, which is rotatably mounted about an axis of rotation 18, preferably perpendicular to the plate, includes a first arm 8*a* and a second arm 8*b* of broadly similar shape and arranged parallel to the first arm. The first arm 8*a* includes a hook 28 at one end, which in FIG. 2*a*, is abutting against or hooked onto a notch 15 of hammer 4. The second arm 8*b* is pushed in the direction of the periphery of the hammer via complementary strip spring 6' in contact with a ramp 30 of the second arm. The complementary strip spring 6' pushes the second arm against a repulsion force generated by a corner 26 of the end portion of bolt spring 7, which acts against an edge 29 at the end of second arm 8*b*. In this situation, bolt spring 7, via corner 26, does not generate sufficient force, relative to the force of complementary strip spring 6', to push, via ramp 30, second arm 8*b* with first arm 8*a* away from the periphery of hammer 4. The friction force of complementary strip spring 6' on ramp 30, and the inclination of the ramp, also play a part in maintaining the hammer in this locked position in the idle mode.

In the idle mode of the striking mechanism, the end of counterspring 5 is theoretically in contact with hammer shaft 9. Lever 12, which is rotatably mounted about axis of rotation 14 of hammer 4, is pushed against shaft 9 by the lever spring which is not shown. The free end of drive spring 6 is not in contact with pin 10, which is also not in contact with circular groove 27 of the end portion of bolt spring 7.

The movement of the elements of the mechanism during the change from the idle mode of the striking mechanism to a strike mode is shown by arrows in dotted lines. Lever 12 is driven in rotation clockwise by a toothed wheel (not shown). The rotation of this lever 12 has the effect of moving shaft 9 and pin 10 clockwise relative to the axis of rotation 14 of hammer 4. Once pin 10 comes into contact with the free end of drive spring 6, this pin 10 pushes drive spring 6 into a pre-wound position as shown hereinafter in FIG. 2*b*. The movement of the drive spring means that the complementary strip spring 6' is no longer in contact with ramp 30. This allows corner 26 of the end portion to push the edge 29 of the second arm 8*b* of bolt 8 away from the periphery of hammer 4.

FIG. 2*b* shows the initial strike mode position with the pre-wound drive spring 6. In this position, the free end of counterspring 5 is no longer in contact with shaft 9, since lever 12 has been rotated to a maximum position by the toothed wheel. Pin 10 holds drive spring 6 in a pre-wound state. Complementary strip spring 6' is no longer in contact with ramp 30 and corner 26 has pushed edge 29 of second arm 8*b* towards the exterior of the periphery of hammer 4. In this condition, the force generated by the bending of the elastic strip of bolt spring 7 as it abuts on drive spring 6 becomes minimal.

FIG. 2*c* shows the moment when hammer 4 first strikes the gong, with the first and second arms 8*a* and 8*b* driven to return into contact with the periphery of the hammer, but prior to the hammer being locked. Driven by drive spring 6 from its pre-wound position towards the gong, hammer 4 strikes the gong for the first time. When the impact portion of the hammer comes into contact with the gong, pin 10 of hammer 4 comes into contact with circular groove 27 of the end portion of bolt spring 7. The effect of the contact of pin 10 in groove 27 is to rotate bolt spring 7 clockwise, as shown by the arrow in dotted lines. Since the hammer is sufficiently heavy, it imparts a large force in groove 27 to rotate the end portion of bolt spring 7 against the bending force of the elastic strip thereof which is abutting on drive spring 6.

The complementary strip spring 6' abuts on ramp 30 to move bolt 8 in the direction of the periphery of the hammer. However, since the hammer has just struck the gong for the first time, hook 28 of first arm 8*a* has not had time to hook onto notch 15 of the hammer. It is only after hammer 4 first strikes the gong, when counterspring 5 pushes the hammer back to its idle position, that hook 28 hooks onto notch 15 of the hammer to keep it locked, which is an object of the invention.

Owing to the locking device of the striking mechanism of this invention, any rebounding of the hammer against the gong is thus prevented. It is therefore no longer necessary to provide the striking mechanism with a counterspring that pushes the hammer back to its idle position with a large force. The force of the counterspring can be minimal, which provides the advantage that there is minimal loss of kinetic energy from the hammer when it strikes the gong to produce a sound of sufficient acoustic level.

From the description that has just been given, several variants of the watch striking mechanism provided with the locking device can be devised by those skilled in the art, without departing from the scope of the invention defined by the claims. The complementary strip spring can be screwed or welded to the main strip of the drive spring once fabricated. The bolt spring can be arranged around the axis of rotation of the bolt. The bolt may have only one arm with at least one hook at the end thereof and support elements for the complementary strip spring and possibly the bolt spring. The bolt can be arranged in a hammer locking or unlocking position by a rectilinear movement. The hammer can be arranged to move in a rectilinear manner to strike the gong. The shaft and/or pin of the hammer can be made directly in the material of the hammer in one piece.

What is claimed is:

1. A watch striking mechanism, the mechanism including:

a gong, which is connected to a gong-carrier, a hammer for striking the gong at predetermined times, a damper counterspring for keeping the hammer at a distance from the gong in an idle mode, and a drive spring for the hammer, which includes a fixed end and an end that is free to move, said drive spring being able to be wound to drive said hammer against the gong in a strike mode in order to produce an acoustic sound, wherein the striking mechanism includes a locking device provided with at least one bolt, which is intended to lock the hammer in an idle mode, and to be moved away from the hammer in a strike mode, when the drive spring is wound, the locking device being arranged such that the drive spring drives the hammer to strike the gong for a first time before the bolt locks the hammer in the idle position following the first strike.

2. The striking mechanism according to claim 1, wherein the hammer is rotatably mounted about an axis of rotation on a watch plate, and wherein it includes an impact portion capable of striking the gong at predetermined times, and an end portion with a hooking means for the locking device.

3. The striking mechanism according to claim 2, wherein the hooking means includes a notch made on a lateral surface at the periphery of an end portion of the hammer.

4. The striking mechanism according to claim 3, wherein the notch is arranged on one side of the axis of rotation opposite the impact portion of the hammer.

5. The striking mechanism according to claim 1, wherein the drive spring and the counterspring are configured in the form of a strip spring, one end of which is fixed to a plate or bridge of the watch, whereas the other end is free to move.

6. The striking mechanism according to claim 5, wherein the hammer includes a shaft on the side of an impact portion of the hammer, which is in contact with the free end of the counterspring, to keep the hammer at a distance from the gong in an idle mode or to push the hammer back to the idle position.

7. The striking mechanism according to claim 5, wherein the hammer includes a pin, arranged in an end portion of the hammer, on the opposite side to an impact portion of the hammer relative to an axis of rotation of the hammer, and wherein a free end of the drive spring is intended to drive the impact portion of the hammer against the gong via the pin when the drive spring is pre-wound in a strike mode.

8. The striking mechanism according to claim 1, wherein the bolt of the locking device is rotatably mounted about an axis of rotation on a plate or bridge of the watch, and wherein the bolt includes a first arm, at the free end of which there is arranged a hooking element in the form of a hook for locking the hammer.

9. The striking mechanism according to claim 8, wherein hook of the bolt is intended to hook onto a notch on an end portion of the hammer.

10. The striking mechanism according to claim 8, wherein the bolt includes a second arm at the free end of which a complementary strip spring, fixed to the drive spring, abuts, the complementary strip spring being intended to push the second arm in the direction of the periphery of the end portion of the hammer, so that the hook hooks onto the notch of the hammer in an idle mode or following the first strike of the hammer against the gong in a strike mode.

11. The striking mechanism according to claim 10, wherein the complementary strip spring is integral with the drive spring, arranged substantially parallel to the drive spring strip and directed towards the free end of the drive spring.

12. The striking mechanism according to claim 11, wherein the free end of the complementary strip spring is intended to abut on a ramp at the free end of the second arm.

13. The striking mechanism according to claim 10, wherein the second arm of the bolt is pushed towards a position at a distance from the periphery of the hammer by a corner of an end portion of a bolt spring in contact with the free end of the second arm, when the complementary strip spring is no longer in contact with the free end of the second arm in a strike mode.

14. The striking mechanism according to claim 13, wherein the bolt spring is rotatably mounted about an axis of rotation, and being in the form of a strip spring with a first free end of the bolt spring in contact with a part of the drive spring and thus to be able to bend and provide a repulsion force to the corner of the portion at the second end of the bolt spring to push the second arm away from the periphery of the hammer.

15. The striking mechanism according to claim 13, wherein the end portion of the bolt spring includes a groove of circular shape for receiving a pin of the hammer in a strike mode after the hammer strikes the gong for the first time, in order to move the corner of the end portion and allow the complementary strip spring to push the second arm in the direction of the periphery of the hammer to lock the hammer after the hammer strikes the gong for the first time.

* * * * *